US007003217B2

(12) United States Patent
Bachinski et al.

(10) Patent No.: US 7,003,217 B2
(45) Date of Patent: Feb. 21, 2006

(54) INFRARED HEATING SYSTEM FOR PATIO UMBRELLA

(75) Inventors: Thomas J. Bachinski, Lakeville, MN (US); Douglas Mark Holm, Minneapolis, MN (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/718,172

(22) Filed: Nov. 19, 2003

(65) Prior Publication Data

US 2005/0105898 A1 May 19, 2005

(51) Int. Cl.
*A45B 11/00* (2006.01)
*H05B 3/00* (2006.01)

(52) U.S. Cl. ..... 392/411; 392/422; 135/16

(58) Field of Classification Search ..... 392/431, 392/411–415, 422, 425, 375–376; 135/16; 362/102; 126/92 A, 92 B; 219/220
See application file for complete search history.

(56) References Cited

U.S. PATENT DOCUMENTS

| | | | | | |
|---|---|---|---|---|---|
| 924,040 | A | * | 6/1909 | Collins | 392/414 |
| 3,313,921 | A | * | 4/1967 | Heinrich et al. | 219/553 |
| 3,739,792 | A | * | 6/1973 | Holland | 135/16 |
| 3,769,503 | A | * | 10/1973 | Kim | 362/280 |
| 4,174,532 | A | * | 11/1979 | Kelley | 362/102 |
| 5,216,948 | A | * | 6/1993 | Sheppard et al. | 99/483 |
| 5,584,564 | A | * | 12/1996 | Phyle | 362/102 |
| 5,964,233 | A | * | 10/1999 | Clark et al. | 135/16 |
| 6,091,888 | A | * | 7/2000 | Jane et al. | 392/365 |
| 6,336,450 | B1 | | 1/2002 | Collet | |
| 6,446,623 | B1 | | 9/2002 | Resmo et al. | |
| 6,470,877 | B1 | | 10/2002 | Waters | |
| 6,598,990 | B1 | * | 7/2003 | Li | 362/102 |
| 6,666,224 | B1 | * | 12/2003 | Lee | 135/16 |
| 6,692,135 | B1 | * | 2/2004 | Li | 362/102 |
| 2003/0136396 | A1 | | 7/2003 | Resmo et al. | |
| 2004/0100799 | A1 | * | 5/2004 | Chu et al. | 362/352 |

FOREIGN PATENT DOCUMENTS

| | | | |
|---|---|---|---|
| DE | 3147085 | * | 6/1983 |
| DE | 10215230 | * | 10/2003 |
| EP | 577196 | * | 1/1994 |
| EP | 851178 | * | 7/1998 |
| EP | 887597 | * | 12/1998 |
| EP | 976979 | * | 2/2000 |
| GB | 1525656 | * | 9/1978 |
| GB | 2381308 | * | 4/2003 |
| JP | 2002-100208 | * | 4/2002 |
| WO | 02/24019 | * | 3/2002 |

* cited by examiner

*Primary Examiner*—John A. Jeffery
(74) *Attorney, Agent, or Firm*—Merchant & Gould P.C.

(57) ABSTRACT

The present invention relates to heating systems for umbrella-shaped structures. The heating system may include a shroud or umbrella-shaped structure defining an inner volume, and a plurality of electrical infrared heating elements positioned generally downward facing in the inner volume of the shroud. The shroud may include radially extending support structures to which the heating elements are mounted.

35 Claims, 4 Drawing Sheets

INFRARED HEATING SYSTEM FOR PATIO UMBRELLA

BACKGROUND OF THE INVENTION

1. Technical Field

The present invention generally relates to heating systems, and more specifically relates to heating system for umbrella-shaped structures.

2. Related Art

Infrared heaters are well known and have been used for many years in various heating applications. Heating with infrared energy is often more efficient than convective forced air heating systems for several reasons. First, convection heating involves a gas (typically air) or liquid that transfers heat from one solid body to another. Because most convection heating uses air as the medium for transferring the heat, convection can only be controlled by air temperature and air speed. In contrast, infrared heating (which includes waves having wavelengths between about 0.75 microns to about 1000 microns) only heats objects and does not heat the air in space that it travels through. Air, the medium for convective heat, is a poor absorber of infrared heat, thus infrared heat can be transmitted long distances with minimum loss of energy to air. When infrared energy is directed onto an object (such as a person), the energy is converted into heat. The heated object then becomes a heat source that transfers heat into the air surrounding the object.

Because infrared waves travel in a straight line at the speed of light, they can be directed in a specific direction toward a specific object. The distance infrared waves travel is dependent on the type of infrared source and the power of the infrared source. The wavelength of the infrared waves may influence the depth of penetration of the infrared waves into the objects. Infrared waves are typically divided into short, medium and long waves through the infrared wavelength spectrum of about 0.75 to 1000 $\mu$m. Short infrared waves generally have the deepest penetration capabilities while long infrared waves have the least penetration capabilities. Infrared heaters may include infrared elements that produce a single or multiple wavelengths depending on the application.

Infrared heating elements are available in a variety of different styles and types. For example, come common style of infrared elements include panel emitters (full trough (FTE), full flat (FFE), have square (HSE), etc.), Edison/light bulb screw-base emitters, and tube emitters. There are also three primary types of infrared elements: ceramic, quartz glass, and metal. A comparison of the three types of infrared elements is shown in Table I.

TABLE I

| | Ceramic | Metal | Quartz |
|---|---|---|---|
| Response Time | Slow | Slow | Fast |
| Longevity | Excellent | Excellent | Good |
| Durability | Good | Excellent | Good |
| Infrared Efficiency | 95% | 55% | 60% |
| Controllability with Integral Thermocouple? | Yes | No | No |
| Maximum Operating Temperature | 1290° F. (700° C.) | 1400° F. (750° C.) | 1600° F. (870° C.) |

Another variable for an infrared element is how the infrared waves are generated. The two primary sources of infrared waves are from electric power and combustion. Those skilled in the art recognize different benefits of electric and combustion infrared generation, such as, for example, efficiency, cost, mobility, maximum temperature, durability, and response time. One example infrared heater, disclosed in U.S. Pat. No. 6,445,623, produces infrared heat by burning propane gas in a combustion chamber. Another infrared heat source is a tungsten halogen high intensity emitter that includes a linear coiled tungsten filament surrounded by a clear quartz glass tube. The addition of a halogen gas to the tube prevents blackening of the tube interior due to evaporation of the tungsten filament. These types of emitters run on electricity and can be configured for a variety of different applications.

SUMMARY OF THE INVENTION

The present invention generally relates to heating systems, and more particularly relates to heating systems for umbrella-shaped structures. In one aspect of the invention, the heating system includes a shroud defining an inner volume, and a plurality of electrical infrared heating elements oriented generally downward or lateral facing in the inner volume of the shroud.

In another aspect of the invention, the heating system includes a plurality of radially extending support members, webbing extending between the radially extending support members, and an infrared heating element secured to an outer surface of at least one of the radially extending supports.

A yet further aspect of the invention relates to a patio umbrella heating system that includes a patio umbrella having radially extending supports and webbing extending between the supports, and a heating element that provides primarily infrared heat. The heating element may be mounted to one of the supports of the umbrella or may be mounted to a mounting structure separate from the webbing and supports, such as, for example, a mounting bracket adjustably mounted to a center support pole of the umbrella.

Another aspect of the invention relates to a heated patio furniture set that includes a table, at least one chair, and an umbrella. The umbrella may include a plurality of radially extending support members, webbing extending between the radially extending support members, and an infrared heating element secured to at least one of the radially extending supports in a generally downward facing direction to direct infrared waves toward the table and chairs.

The above summary of the present invention is not intended to describe each disclosed embodiment or every implementation of the present invention. Figures in the detailed description that follow more particularly exemplified embodiments of the invention. While certain embodiments will be illustrated and described, the invention is not limited to use in such embodiments.

BRIEF DESCRIPTION OF THE DRAWINGS

The invention may be more completely understood in consideration of the following detailed description of various embodiments in the invention and in connection with accompanying drawings, in which.

Figure 2:
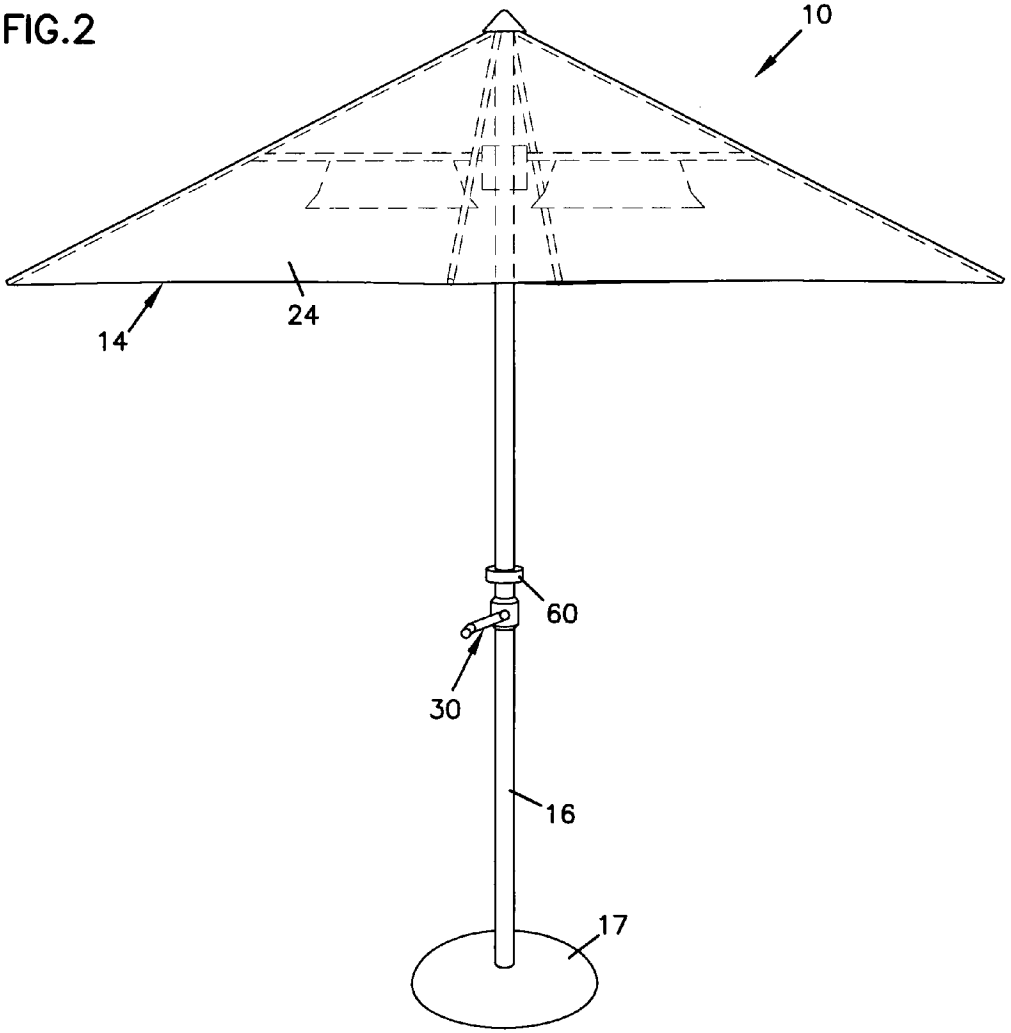
FIG. 2 is a front view of the umbrella of FIG. 1 in a closed position.

While the invention is amenable to various modifications and alternate forms, specifics thereof have been shown by way of example in the drawings and will be described in detail. It should be understood, however, that the invention is not limited to the particular embodiments described. On the contrary, the invention is to cover all modifications, equivalents, and alternatives falling within the spirit and scope of the invention.

DETAILED DESCRIPTION OF THE PREFERRED EMBODIMENT

The present invention generally relates to heating systems, and more particularly relates to heating systems for umbrella-shaped structures. In one aspect of the invention, a heating system is mounted within an inner volume defined by a shroud. The heating system includes at least one infrared heating element positioned generally downward-facing in the inner volume of the shroud to direct heat at objects positioned generally below the shroud.

An infrared heating system may be particularly useful in combination with an outer patio umbrella or other outdoor shading structure. Infrared elements produce infrared waves that pass freely through air (without the air conducting an appreciable amount of heat from the waves) until the waves contact a physical object such as, for example, a person or an inanimate object such as a chair or table. When the object is contacted by the infrared waves, electrons in the object are excited and the object produces heat. The object then becomes a source of heat the increases the air temperature around the object. Thus, the condition of the air (for example, the temperature or air speed) has little impact on the ability of the infrared heating element to heat the intended object. Because of the above-described capabilities and options available with infrared heating, infrared heating is an efficient and effective medium for heating objects, in particular heating objects outdoors.

Figure 1:
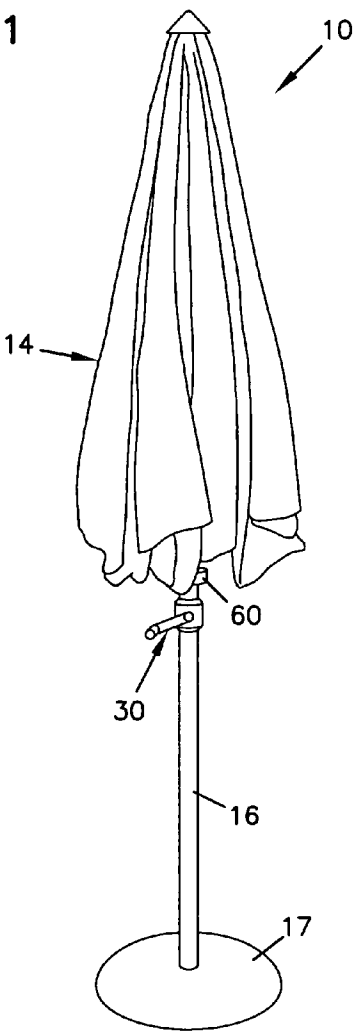
FIG. 1 is a front view of an open umbrella that includes an example infrared heating system and is supported from an under side of the umbrella with a support pole.
Figure 3:
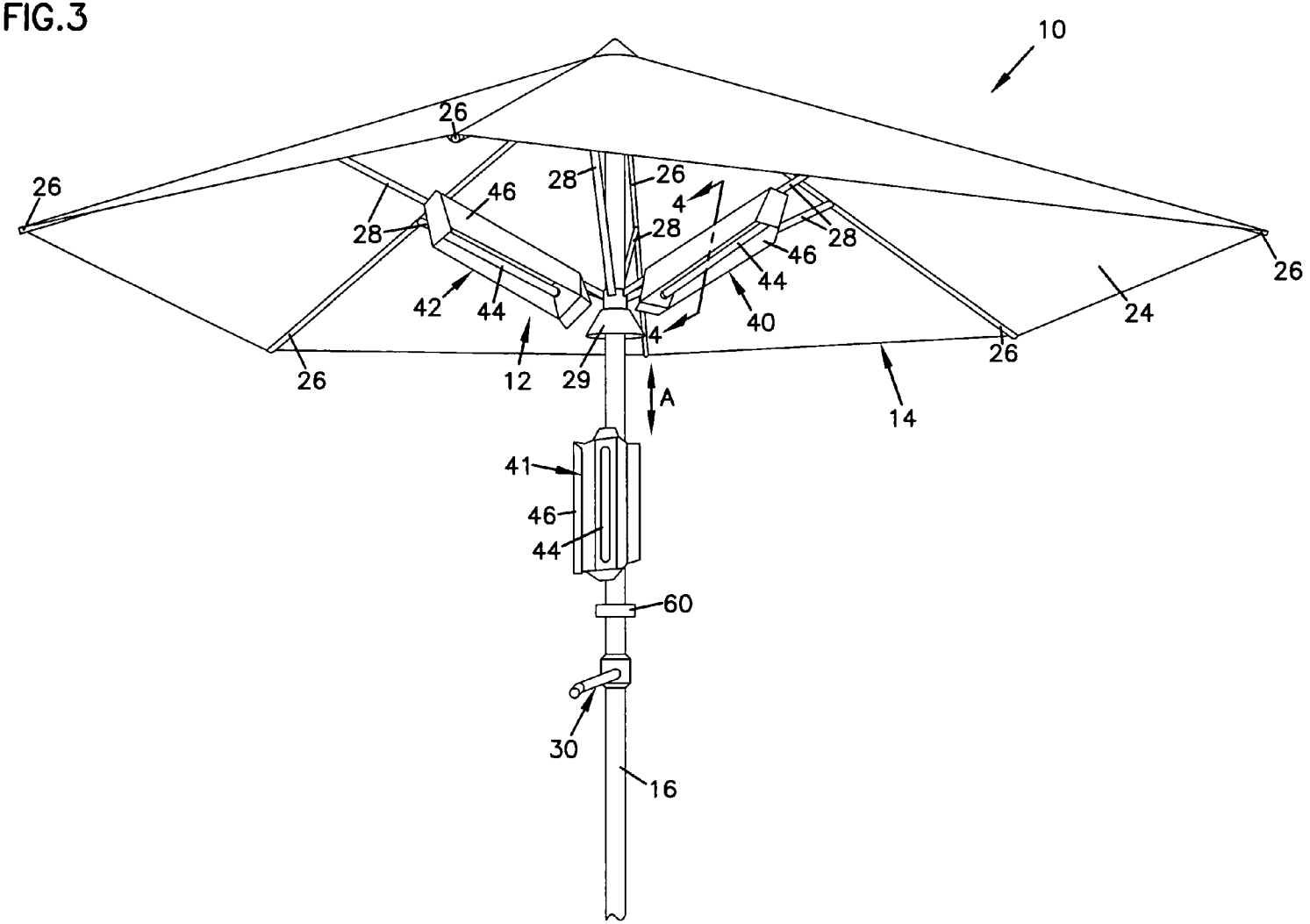
FIG. 3 is a bottom perspective view of the umbrella of FIG. 1.

One example outdoor umbrella assembly 10 that includes an infrared heating system 12, a shroud 14, and a support stand 16 is shown in FIGS. 1–3. Umbrella assembly 10 is shown in an open position in FIGS. 1 and 3 and a closed position in FIG. 2. Shroud 14 includes a webbing 24 that extends between first support members 26. Webbing 24 may be made of a flexible material to promote opening and closing of the umbrella, but may in other embodiments be made of a generally stiff, inflexible material such as a composite, metal or polymer-based material that is formed in sheets. Inflexible webbing material may be especially useful if the umbrella is not intended to be closed (that is, held in a static open position). In embodiments in which an inflexible material is used, support members 26 may not be required is the webbing material itself has sufficient structural integrity to maintain the open position.

The webbing material may be made of a refractive material that reflects some or all of the infrared and radiant waves that may be emanating from the heating members, other portions of the umbrella, or objects positioned vertically below the umbrella shroud that are being heated. The refractive material may allow some types of waves pass through the webbing and may absorb some waves to become a heated black body that emanates heat in return.

Cross support members 28 extend between the first support members and a moveable bracket 29 that is axially movable up and down support stand 16. An open/close crank 30 of support stand 16 may be used to move the moveable bracket 29 up and down the support stand thereby moving the shroud between open and closed positions. Support stand 16 may include a support base 17 that helps maintain umbrella 10 in a generally upright orientation.

When shroud 14 is in an open position, the cross support members 28 preferably extend in a generally horizontal direction so as to provide a stable and generally level mounting surface for heating members 40, 42 of the infrared heating system 12. Another vertically oriented heating element 41 (see FIG. 3) may be mounted to the support stand 10 or other structure of the umbrella assembly 10 so that the heating element is open in a generally lateral (horizontal) direction. Heating members 40–42 include an infrared element 44 and a reflective cover 46. As shown in FIG. 3 and the cross-sectional view of FIG. 4, heating members 40 and 42 are mounted to cross support members 28 with an open side of the heating member 40, 42 facing generally downward. A connector 48 may be used to secure the heating members 40, 42 to the cross-support members 28 (see FIG. 4). Heating member 41 may be similarly secured to the support stand 16 or other support structure. Although heating member 41 is shown oriented in a lateral direction, it could also be directed in any other direction and could be adjustably mounted to support stand 16 so as to be movable in the direction "A" shown in FIG. 3.

Infrared element 44 may be any of a variety of different types and styles of infrared elements as described in the background section above, and primarily produces only infrared waves. Although some infrared elements are designed to produce a certain type of visible light wave or other types of waves for specific purposes (for example, to indicate when the element is being powered), most infrared elements for use in the infrared heating system of the present application produce substantially solely infrared waves.

Figure 5:
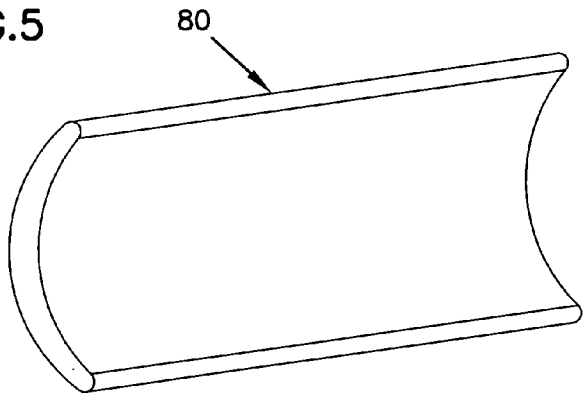
FIG. 5 is front perspective view of an example panel infrared element that may be used according to principles of the invention.

Some example infrared element configurations include a quartz glass tube infrared emitter that includes a filament 50 and a quartz glass tube 52 (see FIG. 4), a ceramic, metal or quartz infrared emitter in the form of a panel (see panel 80 shown in FIG. 5), a tube (see feature 44 shown in FIGS. 3 and 4), an Edison-type bulb, or any other style of infrared emitter that has a shape and size to fit within shroud 14 and can be supported by cross-support members 28, first support member 26, and support stand 16.

Figure 4:
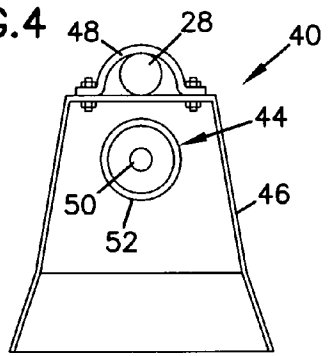
FIG. 4 is a cross-sectional view of the infrared element shown in FIG. 3 taken along cross-sectional indicators 4—4.

Reflective cover 46 is shown in FIGS. 3 and 4 as having a generally box-like shape with a rectangular or triangular cross-section and that is open on at least one side. The side walls of reflective cover 46 may be flared outward or otherwise shaped to help direct the infrared waves downward toward objects below shroud 14. Reflective cover 46 may, in other embodiments, have different shapes and sizes to accommodate the style and type of infrared element being used. Preferably, reflective cover 46 includes at least a single panel position adjacent to the infrared element 44 vertically above the infrared element so as to help direct the infrared waves generally downward and away from webbing 24.

Reflective cover 46 may be made of sheet metal or other sheet material that is stamped, bent or otherwise formed and assembled into the desired shape. Reflective cover 46 may also be made of ceramic or other insulated and/or reflective materials such as, for example, a molded member that includes ceramic fiber and a binder. One example molded material that may be especially useful as a reflective cover is disclosed in U.S. Published Patent Application No. 2003/0049575, which is incorporated herein by reference.

An infrared system according to principles of the invention may include at least one heating member supported by at least one support member of the shroud, the support stand of the umbrella assembly, or any combination of thereof. For example, each heating member may be supported by two or more cross-support members, a first support member and a cross-support member, or a cross-support member and the support stand. The heating elements may be secured to a mounting bracket that is supported by the support stand or a similar feature of the umbrella. Such a mounting bracket may be adjustably coupled to the umbrella so that the heating elements can be moved relative to objects below or to the side of the umbrella. For example, the heating elements may be mounted in a higher position when the persons using the umbrella are standing, and the heating elements may be moved to a lower position when the persons are sitting.

Figure 6:
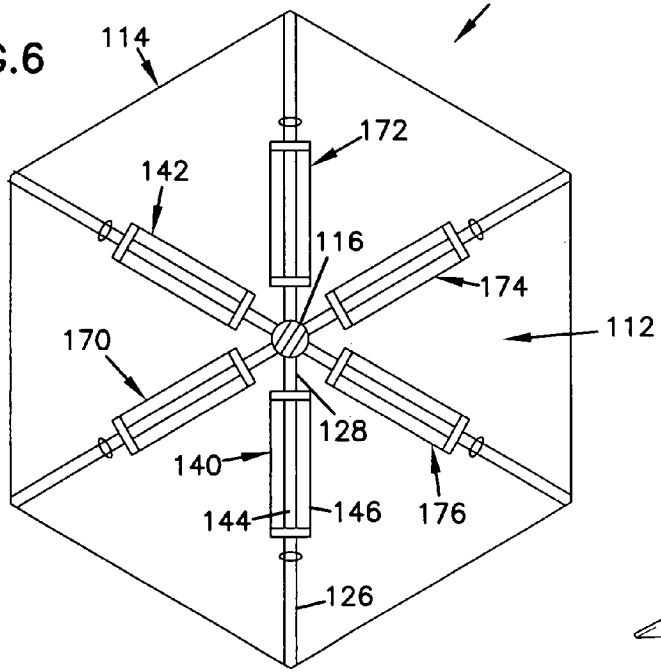
FIG. 6 is a bottom view of an open umbrella that includes a heating element for each support arm of the umbrella.

The infrared heating system may include a separate heating member 140, 142, 170, 172, 174, 176 for each cross-support 126 as shown in the umbrella assembly 100 of FIG. 6. Heating members 140, 142, 170, 172, 174, 176 are separately supported on individual cross-support members 128, which are in turn supported by support stand 116 and first support members 126 and positioned within a volume defined by shroud 114. In yet further embodiments, a single cross-support member, a first support member, or the support stand may each support two or more heating members (not shown).

As mentioned above, one embodiment of the invention may include an umbrella with a rigid or semi-rigid webbing, for example, with an umbrella that maintains a static open position. Such a webbing may, by itself, be able to support at least one heating member. In other configurations that include a rigid or semi-rigid webbing, the heating member may be supported by the support stand rather than being supported by the cross-support or first support members.

Figure 7:
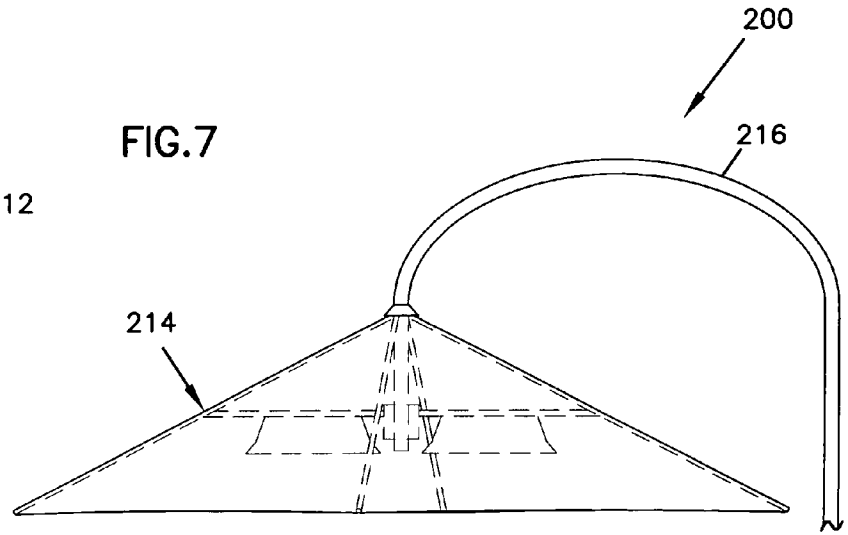
FIG. 7 is a side view of an open umbrella that included one example infrared heating system and is supported at an upper side of the umbrella with a support pole.

Umbrella assembly 10 is supported by vertical support stand 16 from below shroud 14 as shown in FIG. 1-3. FIG. 7 illustrates an alternative umbrella assembly 200 that include a shroud 214 and an infrared heating system (shown in phantom) that is supported from above by support stand 216. Support stand 216 may include a general arc shape that extends over the top of shroud 214 and is supported on the ground at a lateral side of shroud 214. In another variation of assembly 200, one end of support stand 216 may be secured to the top of shroud 214 while a second end of the stand is supported by an independent structure such as a building or a vehicle.

Operation of an infrared heating system may be controlled by automatic or manual controls. For example, as shown in FIGS. 1 and 2, umbrella assembly 10 may include controls 60 mounted to support stand 16 for easy access by a user to control the functions of infrared heating system 12. Control panel 60 may include various automatic and manual controls and electronic devices such as, for example, a position sensor, a thermostat, an on/off switch, a temperature sensor, and a variable power control.

The position sensor may be used to monitor when an object moves into our out of a predetermined proximity to the umbrella assembly, and then send an electronic signal to automatically turn on or off the heating members 40, 42. The thermostat may be used to automatically or manually change the amount of power supplied to the heating members. The thermostat may be used in conjunction with the temperature sensor positioned within or adjacent to objects in proximity to the umbrella assembly 10, such as, for example, a table or chairs beneath shroud 14 that are being heated by the heating members 40, 42. The on/off switch may include or be separate from the variable power control that determines the power supplied to the heating member 40, 42.

The on/off switch may be automatically activated to turn the heating members 40, 42 off when the umbrella assembly 10 is brought into a closed position so as to prevent accidental damage to webbing 24 or other features of the umbrella assembly 10 if the heating were otherwise inadvertently left on when the umbrella assembly 10 is closed. The on/off switch may also be used in conjunction with the temperature sensor to turn the hearting elements on or off depending on the sensed temperature of certain umbrella features or other bodies in close proximity to the umbrella. The temperature sensor may also activate a locking mechanism that prevents the umbrella from being closed when the heating elements or other features in close proximity to the umbrella are above a predetermined temperature.

Features associated with controls 60 may be activated from a remote location using, for example, remote control, radio frequency, or other technology so that the heating element or other features of umbrella assembly 10 can be controlled from a distant location.

Heating members 40, 42 thus may be powered by a common 110 volt power source, a DC power source (such as a rechargeable battery), or may be powered by the combustion of gas or other common combustible material provided by, for example, a mobile gas tank such as a propane tank, or a natural gas line fed to the heating members. The electrical wiring and/or fuel lines for heating members 40, 42 may extend through support stand 16 and the support members 26, 28, or may extend along an outside surface of stand 16 and support members 26, 28 when, for example, the infrared heating system is retrofit to an umbrella assembly as an after market product.

One advantage of the above-described infrared heating systems when used with a patio umbrella or other outdoor shading structure is the full-season use and enjoyment of the outdoors, in particular the patio, deck or outdoor living area of, for example, a home, restaurant, or park. Because infrared heat is efficient and effective even during cold temperatures or windy conditions, a user or object can be heated in the outdoors to a comfortable temperature with the same umbrella structure used during warmer conditions to provide shade.

Figure 8:
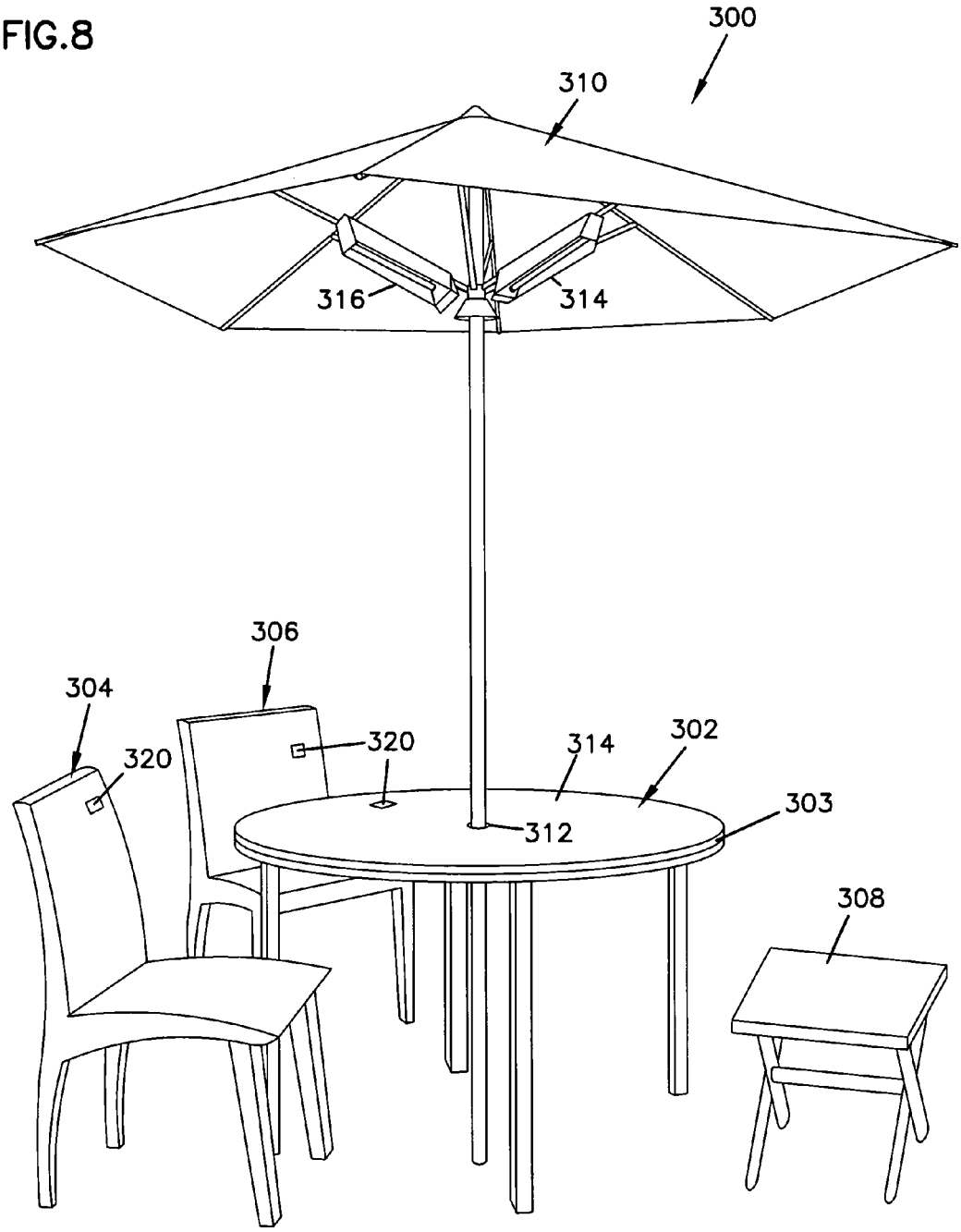
FIG. 8 is a perspective view of a patio furniture set that includes an open umbrella to which an example infrared heating system is mounted.

A patio umbrella 310 that includes example infrared heating systems 314, 316 may be part of a patio set 300 that includes a table 302, chairs 304, 306, and other common patio furniture such as an end table 308, as shown in FIG. 8. The patio umbrella 310 may be supported by the table, for example, by extending through a hole 312 formed in a center of the table top 314 (as shown in FIG. 8) so as to help maintain the umbrella 310 in a generally upright position, or may include separate support structures that support the umbrella independent of the other patio set pieces (for example, see support base 17 of umbrella 10 shown in FIG. 1).

Use of the patio umbrella 310 in association with other patio set pieces, such as table 302, may be advantageous for storing or otherwise coving certain features of the infrared heating system, such as the energy source (e.g., wiring, fuel tanks, batteries, etc.) that powers the infrared heating elements (not shown). In addition, some of the patio set pieces may include heat sensors 320 associated with the infrared heating system to monitor heat generated in those pieces from infrared waves generated by the infrared heating elements. Further, at least some of the patio set pieces or portions of those pieces (for example, a top layer 303 of table 302) may be made of ceramic fiber and a binder and have the properties of high heat reflection or high heat absorption and radiation to help heat the air around the patio piece upon being heated by the infrared heating elements.

In one aspect of the invention, the heating system includes a shroud defining an inner volume, and a plurality of electrical or combustion infrared heating elements positioned generally downward facing in the inner volume of the shroud. The shroud may include a support member to which the heating elements are secured.

In another aspect of the invention, the heating system includes a plurality of radially extending support members, webbing extending between the radially extending support members, and an infrared heating element secured to an outer surface of at least one of the radially extending supports. The infrared heating element may be a quartz glass, ceramic or metal infrared emitter; and may be, for example, a tube, panel, or Edison bulb style of emitter. Further, the infrared heating element may have many different shapes, such as, for example, an elongate cylindrical shape, a circular or semi-circular shape, or a polygonal shape.

A yet further aspect of the invention relates to a patio umbrella heating system that includes a patio umbrella having radially extending supports and webbing extending between the supports, and a heating element providing substantially solely infrared heat that is mounted to one of the supports.

Another aspect of the invention relates to a method of heating objects in proximity to a patio umbrella using an infrared heating element. The method may includes the steps of opening the umbrella, supporting the infrared heating element with the umbrella, orienting the infrared heating elements in a generally downward direction, and directing infrared waves from the infrared heating element to the objects.

Another aspect of the invention relates to a heated patio furniture set that includes a table, at least one chair, and an umbrella. The umbrella may include a plurality of radially extending support members, webbing extending between the radially extending support members, and an infrared heating element secured to at least one of the radially extending supports in a generally downward facing direction to direct infrared waves toward the table and chairs. The patio furniture may include a material that absorbs at least some of the infrared waves and is heated as a result of the absorption.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

We claim:

1. A heating system, comprising:

a collapsible shroud defining an inner volume when in an open position and comprising a heat resistant material;

a plurality of tube-shaped electrical infrared heating elements oriented in a generally horizontal plane and positioned within the inner volume of the shroud, wherein the infrared heating elements provide substantially solely infrared heat and substantially no visible light; and a plurality of reflectors, each reflector being associated with a separate heating element and being positioned between all portions of the heating element exposed to the shroud and the shroud to direct the infrared heat away from the shroud, the reflectors being spaced apart from the shroud with an air insulative space there between.

2. The system of claim 1, wherein the shroud includes a plurality of radially extending supports and the heating elements are mounted an exterior surfaces of the radially extending supports.

3. The system of claim 1, wherein the infrared heating elements each include an electric filament enclosed in a quartz glass housing.

4. The system of claim 1, wherein the shroud includes refractive material.

5. The system of claim 1, further comprising at least one heat sensor configured to monitor temperatures of objects heated by the heating elements.

6. The system of claim 1, wherein the heating elements provide infrared waves having a wavelength between about 1 $\mu$m to about 20 $\mu$m.

7. A patio umbrella heating system, comprising:

a patio umbrella including:

a stand member;

a plurality of webbing supports extending in a generally radial direction from the stand member;

webbing extending between the webbing supports;

a plurality of intermediate supports extending between the stand member and the webbing supports; and at least one heating element providing substantially solely infrared heat, the heating element being mounted to the intermediate supports.

8. The system of claim 7, further comprising two or more heating elements, wherein each heating element is mounted to a separate intermediate support.

9. The system of claim 7, further comprising controls for controlling functions of the heating element.

10. The system of claim 9, wherein the controls are mounted to the support pole.

11. The system of claim 7, wherein the stand member is secured to the umbrella at a central portion of the umbrella and extends downward from the umbrella.

12. The system of claim 7, wherein the stand member is secured to the umbrella at a central portion of the umbrella and extends upward from the umbrella.

13. The system of claim 7, wherein the webbing supports are curved so as to form a downward facing concave shape.

14. The system of claim 7, wherein the webbing supports are straight and extend at angle less than 90 degrees relative to an axis of the stand member from a central point of the umbrella downward to form a conical shape.

15. The system of claim 7, wherein the umbrella is adjustable between an open position and a closed position.

16. The system of claim 7, wherein the heating element is substantially downward facing.

17. The system of claim 7, further comprising at least two heating elements, wherein at least one of the heating elements is radially inward facing in a direction substantially perpendicular to an axis of the stand member.

18. The system of claim 7, wherein the heating elements are electronic.

19. The system of claim 7, wherein the heating elements generate heat using combustion.

20. The system of claim 7, further comprising a proximity sensor that generates an on/off signal forte heating elements in response to an object being positioned near the patio umbrella.

21. The system of claim 7, further comprising an heating element switch tat is operable to automatically turn the heating element off when the umbrella is adjusted from an open position to a closed position.

22. A heating system, comprising:

a stand member a plurality of webbing support members extending generally radially from the stand member;

webbing extending between the webbing support members;

a plurality of intermediate support members coupled between the radially extending support members and the stand member; and an infrared heating element secured to an outer surface of at least one of the intermediate support members, the infrared heating element providing substantially solely infrared heat.

23. The system of claim 22, wherein the infrared beating element is oriented in a generally downward facing direction.

24. The system of claim 22, wherein the infrared heating element is powered by electricity.

25. The system of claim 22, further comprising a reflector positioned adjacent to an upward facing side of the infrared heating element to reflect downward the infrared waves produced by the infrared heating element.

26. The system of claim 25, wherein the reflector comprises sheet metal.

27. The system of claim 25, wherein the reflector comprises a ceramic fiber and a binder.

28. The system of claim 25, wherein the infrared heating element is a ceramic infrared emitter.

29. The system of claim 25, wherein the infrared heating element is a metal infrared emitter.

30. The system of claim 25, wherein the infrared heating element is a quartz glass infrared emitter.

31. The system of claim 25, wherein the infrared heating element is selected from a group consisting of a tube, a panel and an Edison bulb type infrared emitter.

32. A method of heating objects in proximity to a patio umbrella using an infrared heating element, the umbrella including a shroud, a plurality of elongate support ribs extending from a center of the shroud towards outer edges of the shroud and a stand member, the method comprising the steps of:

opening the umbrella;

supporting the infrared heating element wit the support ribs within an umbrella enclosure defined by the opened umbrella;

orienting the infrared heating element in a generally downward direction;

positioning the infrared heating element at a location within the umbrella enclosure spaced apart from the shroud with an air insulative spacing there between; and directing substantially solely infrared waves and substantially no light from the infrared heating element to the objects without heating air positioned between the objects and the infrared heating element.

33. A heated patio furniture set, comprising:

a table;

at least one chair;

an umbrella comprising:

a plurality of radially extending support members;

webbing extending between the radially extending support members; and an infrared heating element secured to an outer surface of at least one of the radially extending supports in a generally downward facing direction to direct infrared waves toward the table and chairs, the infrared heating element being configured to produce substantially solely waves having wavelengths tat are absorbed by solid structures and not by air; and a heat sensor mounted to the table or to the chair, the heat sensor being configured to determine an amount of heat generated in the table or chair to which the heat sensor is mounted, the heat being generated by the directed infrared waves.

34. The furniture set of claim 33, wherein the furniture comprises a material tat absorbs at least some of the infrared waves and is heated.

35. The furniture set of claim 33, wherein the umbrella is supported in an upright position with the table.

* * * * *